United States Patent [19]

Brooksbank et al.

[11] 4,061,803

[45] Dec. 6, 1977

[54] LEATHER BELTS OR APRONS FOR TEXTILE MACHINES

[76] Inventors: Wallace Ronald Brooksbank, Croft House, Hetton, Skipton; David Toft, 6 Brackenley Drive, Embsay, both of North Yorkshire, England

[21] Appl. No.: 665,189

[22] Filed: Mar. 9, 1976

[51] Int. Cl.[2] ..... B05D 3/00; B05D 3/02; B05D 3/12

[52] U.S. Cl. ..... 427/323; 427/365; 427/366; 427/389

[58] Field of Search ..... 427/323, 365, 366, 389

[56] References Cited

U.S. PATENT DOCUMENTS

| | | | |
|---|---|---|---|
| 1,225,389 | 5/1917 | Alexander | 427/389 X |
| 3,178,310 | 4/1965 | Berger et al. | 427/389 |
| 3,245,832 | 4/1966 | Doggett et al. | 427/389 X |

*Primary Examiner*—Michael R. Lusignan
*Attorney, Agent, or Firm*—Norris & Bateman

[57] ABSTRACT

The invention relates to the production of leather belts and aprons for textile machines in which the natural smooth and relatively non-fibrous grain surface of the leather is removed to expose the natural inner flesh surface and subjecting the surface to mechanical treatment by setting or rolling to compact the surface and impregnating the surface with a polymeric substance to consolidate the surface layer to produce a belt or apron with a smooth non-tacky surface.

5 Claims, No Drawings

LEATHER BELTS OR APRONS FOR TEXTILE MACHINES

This invention relates to improvements in leather belts or aprons, particularly for textile machines.

Leather belts or aprons employed on machines for processing textile fibres, in particular leather belts or aprons which are driven and gripped by or caused to run around or between fluted rollers in the course of transporting and gripping fibres on machines for combing or grilling such fibres, are subjected to considerable wear and tear in use.

Such belts or aprons are constructed for specially treated leather or alternatively from plastic or synthetic materials but in general leather belts or aprons are preferred because although partly fibrous and partly relatively non-fibrous their natural integral composition offers greater wear and tear resistance than that offered by a synthetic belt or apron. Also the smooth outer working surface of the leather belt or aprons being the natural smooth grain and relatively non-fibrous surface of the leather is considered to be an ideal surface on which to transport the textile fibres between around and through the fluted rollers.

Recent developments in machines for combing and gilling textile fibres however have been influenced by the desire for much greater rates of production through the machines and one means of achieving this is by reducing the thickness of the belt or apron thus allowing a closer setting of the rollers to the comb. Requests are made for leather belts of little more than half the thickness of those traditionally supplied and suitable leather is not available naturally in such reduced thicknesses. It has thus been necessary to reduce the thickness of the natural leather.

The normal manner of reducing the thickness of leather belts or aprons for these machines has been to remove material from the flesh or inside surface of the natural leather until the desired final thickness of smooth grain leather is left, it having been universally assumed that it was essential to retain the smooth grain surface intact to ensure satisfactory operation. In carrying out this operation of removing the flesh surface to a greater or lesser degree the strongest and most tear resistant layers of the leather have been removed thus producing a relatively weak and unstable belt or apron which is liable to fail prematurely due to excessive stretching, narrowing, tearing or cutting through.

It has now been surprisingly found that it is not essential to retain the natural smooth and relatively non-fibrous grain surface of the leather as an outer working surface and that satisfactory performance can be achieved from a belt or apron with the outer working surface comprised wholly or partly of the naturally fibrous central layer or the flesh side of the leather, provided such surface is treated to provide a smooth surface. This permits a much thinner leather belt or apron to be provided whilst retaining intact as part of the belt the entire natural flesh or inside surface of the leather and thus its maximum strength and tear resistance.

According to the invention a method for producing a leather belt or apron for conveying fibres on textile machines by retaining intact or substantially intact the natural inner or flesh surface of the leather comprises removing all or part of the natural smooth grain surface from the leather to leave an intermediate surface exposed, subjecting the intermediate exposed surface to mechanised treatment by setting and/or rolling to compact the surface fibres and impregnating the surface with a polymeric material to consolidate the intermediate surface layer and produce a belt or apron with a smooth flexible non-tacky surface.

In carrying out the invention the natural grain or smooth outer layer of the leather is removed to a greater or less degree by known means during the treatment of the leather and the resulting exposed fibrous surface at the outer side of the leather is then given further treatment to smooth the exposed fibrous layer forming this surface.

This outer fibrous layer may be treated mechanically and chemically preferably with oils, fats, waxes or resinous materials or plastics to ensure lack of adhesion between the new outer working surface of the leather and the textile fibres being carried thereby.

The fibrous surface of the leather now becoming the outer working surface of the belt or apron may be dyed where necessary, treated mechanically by setting or rolling to compact the surface fibres, and may be impregnated with a polymeric material of either synthetic or natural origin to consolidate the surface layer thus preventing any detrimental interaction with the textile fibres travelling thereon when the belt or apron is in use. The impregnants may be emulsions or solutions of polyurethanes, polyvinyl compounds, alginates and similar materials modified if necessary to produce a flexible non-tacky surface by addition of tack modifiers or plasticisers.

EXAMPLE 1

The exposed leather surface is treated with a solution of polyurethane (Desmocoll 406 — Bayer) in ethyl acetate solvent containing 5% of an isocyanate hardener (Desmodur L 75% — Bayer) to act as a tack modifier. After drying off for about 10 minutes the leather is pressed to compact the surface layer.

EXAMPLE 2

The exposed leather surface is treated with a mixture of polyacrylic emulsions. A mixture of 80% Lepton Binder SP (BASF) and 20% Corial Binder ON (BASF) is applied to the leather surface, allowed to dry and hot plated (260° F) to produce a smooth surface.

EXAMPLE 3

The exposed leather surface is treated with a 10% solution of sodium alignate (MANUTEX — Alginate Industries Ltd.,) in water containing 10% sulphonated cod oil (ELVIC CSC — Vickers Oils Ltd.,) to act as a plasticiser.

Leather treated as hereinbefore described produces a belt or apron having the requisite properties for use on high speed textile processing machines namely a reduction in thickness without a corresponding reduction in strength and wearing quality and a smooth polished surface for conveying the textile fibres and to which they will not adhere.

What we claim is:

1. A method for the production of a relatively thin leather belt or apron for conveying textile fibres on textile machines from natural leather having an outer smooth non-fibrous side and an inner fibrous side which comprises the steps of removing from said natural leather a layer of substantial depth at the non-fibrous outer smooth side to thereby outwardly expose an intermediate fibrous surface while retaining substantially intact the original fibrous inner side of said natural leather, subjecting said exposed surface to mechanical treatment to compact the fibres at said exposed surface, and impregnating said exposed surface with a polymeric material, whereby to produce a belt or apron having a smooth flexible non-tacky outer textile fiber conveying surface.

2. The method defined in claim 1, wherein said removed layer is compacted by setting or rolling.

3. The method defined in claim 1, wherein said polymeric material is a material selected from the group consisting of polyurethanes, polyvinyl compounds and alginates.

4. The method defined in claim 1, wherein said polymeric material is a mixture of polyacrylic emulsions.

5. The method defined in claim 1, wherein said exposed surface is impregnated with a 10% solution of sodium alginate in water containing 10% sulphonated cod oil as a plasticiser.

* * * * *